US005439045A

United States Patent [19]

Crafton

[11] Patent Number: 5,439,045

[45] Date of Patent: Aug. 8, 1995

[54] METHOD OF HEAT TREATING METAL CASTINGS, REMOVING CORES, AND INCINERATING WASTE GASSES

[75] Inventor: Scott P. Crafton, Kennesaw, Ga.

[73] Assignee: Consolidated Engineering Company, Inc., Kennesaw, Ga.

[21] Appl. No.: 183,724

[22] Filed: Jan. 19, 1994

[51] Int. Cl.[6] ..... B22D 29/00

[52] U.S. Cl. ..... 164/5; 164/132

[58] Field of Search ..... 164/5, 132, 76.1

[56] References Cited

U.S. PATENT DOCUMENTS

| | | | |
|---|---|---|---|
| 3,737,280 | 6/1973 | Cromp | 432/41 |
| 3,941,868 | 3/1976 | Riester | 164/76.1 X |
| 4,136,636 | 1/1979 | Ellison et al. | 118/68 |
| 4,140,467 | 2/1979 | Ellison et al. | 432/72 |
| 4,198,764 | 4/1980 | Ellison et al. | 34/32 |
| 4,206,553 | 6/1980 | Ellison et al. | 34/28 |
| 4,457,352 | 7/1984 | Scheffer | 164/5 |
| 4,478,572 | 10/1984 | Selli | 164/5 X |
| 4,579,319 | 4/1986 | Sasaki | 266/252 |
| 4,662,840 | 5/1987 | Ellison | 432/8 |
| 4,678,433 | 7/1987 | Ellison | 432/59 |
| 5,253,698 | 10/1993 | Keough et al. | 164/5 X |
| 5,294,094 | 3/1994 | Crafton et al. | 266/44 |
| 5,354,038 | 10/1994 | Crafton | 164/132 X |

FOREIGN PATENT DOCUMENTS

| | | | |
|---|---|---|---|
| 2914221 | 10/1980 | Germany | 164/5 |
| 4012158 | 11/1990 | Germany | 164/5 |
| 59-39464 | 3/1984 | Japan | 164/76.1 |
| 62-47100 | 10/1987 | Japan | 164/5 |
| 2230720A | 10/1990 | United Kingdom | 164/132 |
| 1129012 | 12/1984 | U.S.S.R. | 164/5 |

*Primary Examiner*—J. Reed Batten, Jr.
*Attorney, Agent, or Firm*—Louis T. Tsaf; James A. Witherspoon

[57] ABSTRACT

Waste gasses generated in the process of manufacturing cores and castings are collected and inventively routed to a heat treating furnace for incineration. Additionally, as a portion of the waste gas is being routed, it is put to use in the reclaiming of uncured scrap materials and the reclaiming of sand within the furnace. Additionally, provisions are made for decreasing the height of the furnace by decreasing the height of hoppers therein and increasing the size of the base of the hoppers to maintain proper flow of reclaimed sand and portions of core materials being reclaimed therein toward the base of the hopper. Multiple fluidizers are employed in the base of the hopper to accommodate for the increased size of the base of the hopper and maintain optimum flow of materials toward the base and optimum fluidization of the materials within the hopper.

18 Claims, 2 Drawing Sheets

METHOD OF HEAT TREATING METAL CASTINGS, REMOVING CORES, AND INCINERATING WASTE GASSES

BACKGROUND OF THE INVENTION

The present invention relates generally to the field of metal castings, and in its most preferred embodiments to the field of methods and systems for manufacturing hollow metal castings.

Methods and apparatus for manufacturing hollow metal castings such as, for example, cylinder heads and engine blocks, are well known. Conventionally, multiple discrete methods and apparatus are employed in the manufacture of metal castings. For example, in accordance with one conventional method, a core machine is employed to manufacture cores and molds from sand and a combustible binder. At a casting machine that is remote from the core machine, molten metal is poured into a mold with a core properly disposed therein. Then, the core and mold are removed from the newly formed casting at a "shake-out" machine by forcibly shaking the newly formed casting and breaking the core and mold away therefrom. At a location remote from the "shake-out" machine, sand is reclaimed from the broken cores and molds in a reclaiming machine. After "shake-out", and at a location remote from the "shake-out" machine, the newly formed castings are introduced into a heat treating furnace for heat treatment. Because each of the above steps are conventionally carried out by discrete pieces of equipment, capital equipment costs, floor space requirements, and operating costs are typically not maximized.

Revolutionary improvements have recently been made to minimize capital equipment costs, floor space requirements, and operating costs. The revolutionary improvements are embodied in a multifunctional furnace that eliminates and synergistically combines certain of the above-identified steps and the equipment therefore. The revolutionary improvements are fully disclosed in U.S. Pat. Nos. 5,354,038 and 3,294,094, each of which is expressly incorporated herein, it in its entirety, by reference. The improvements disclosed in those patents totally eliminate the need for any "shake-out" to remove cores and molds (referred to hereafter together as cores) from castings. The multifunctional furnace, in addition to heat treating, removes cores and molds from castings. The combustible binder that binds cores is combusted in the multifunctional furnace and differential pressure is established across the castings, whereby cores fall from castings while the castings are within the multifunctional furnace. The cores that fall from the castings actually fall in pieces, and the pieces of core are collected in hoppers within the multifunctional furnace. Sand is reclaimed from the pieces of core while within the hoppers, in part, by the action of fluidizers. While the inventions disclosed in the patents incorporated herein by reference have revolutionized the methods and apparatus for manufacturing hollow metal castings, room for inventive improvement still remains.

As discussed briefly above, cores are typically constructed in core machines where sand and a combustible binder are combined. Additionally, an inducing gas is typically injected into core machines to facilitate curing of the combustible binder. An excess amount of inducing gas is commonly supplied to facilitate the curing, and typically a large percentage of inducing gas escapes from the core machine into the workplace and surrounding environment. An acceptable inducing gas, and one that is commonly employed, is amine gas. The escape of amine gas from the core machine is thought to be a potential workplace and environmental hazard. An additional problem with respect to the formation of cores is that some of the combustible binder within core machines is often not cured and is therefor not solidified. Thus, there is a nonsolidified mixture of core materials (i.e., uncured scrap) which is a messy waste product that must, unfortunately, be contended with.

As mentioned above, after formation of cores and molds, cores are properly disposed within molds and molten casting material is poured into the molds while they are in a casting machine. The molten casting material is typically at a temperature that is above the combustion temperature of the binder material of the mold and core, whereby the mold and core smolder and emit noxious fumes that commonly escape from the casting machine to pose a potential workplace and environmental hazard.

Room for improvement additionally exits with respect to the improved multifunctional furnaces disclosed in the patents incorporated herein by reference. These multi functional furnaces have a tendency in certain circumstances to be higher than some older conventional furnaces due, in part, to their inventive incorporation of components not included in conventional furnaces. Thus, it can be difficult in some cases to physically fit the improved multifunctional furnaces into an older factory or building due to ceiling or roof clearance problems.

SUMMARY OF THE INVENTION

Briefly described, the present invention includes an improved method and system for manufacturing hollow metal castings. Central to the system is an inventive furnace. Some of the major aspects of the furnace are disclosed in the patents previously incorporated herein by reference. For example, the furnace is constructed so as to (i) heat treat castings therein, (ii) remove cores from the castings being heat treated therein, and (iii) reclaim therein sand from cores, wherein this reclamation is carried out in part by fluidizing.

In accordance with a preferred embodiment of the present invention, waste gasses generated in the process of manufacturing cores and castings are collected and inventively routed to the furnace for incineration. Additionally, as a portion of the waste gas is being routed, it is put to use in the reclaiming of uncured scrap materials and the reclaiming of sand within the furnace. Additionally, provisions are made for decreasing the height of the furnace by decreasing the height of hoppers therein and increasing the size of the base of the hoppers to maintain proper flow of reclaimed sand and portions of core materials toward the base of the hopper. Multiple fluidizers are employed in the enlarged bases of the hoppers to maintain optimum flow of materials toward the bases and optimum fluidization of the materials within the hoppers.

More specifically, in accordance with a first preferred embodiment of the present invention, the furnace includes an entrance zone in which molten casting materials are poured into castings. Fumes generated during the pouring process are drawn into a heated portion of the furnace for incineration purposes. Furthermore, in accordance with the first preferred embodiment of the present invention, excess inducing gas that is injected into a core machine is drawn from the core machine, along with air, and utilized by the fluidizers for fluidizing within the furnace. Furthermore, uncured core scrap from the core machine is collected and cured with inducing gas drawn from the core machine, whereby the uncured scrap is transformed into a readily handleable cured scrap. The cured scrap is transported to a sand refinement unit, which is disclosed in one of the patents incorporated by reference, where the reclaiming of sand from the cured scrap is preferably begun. The sand refinement unit discharges into the furnace where the reclaiming of sand is completed.

It is therefore an object of the present invention to provide an improved method and system for manufacturing hollow metal castings.

Another object of the present invention is to minimize capital equipment costs, floor space requirements, and operating costs.

Yet another object of the present invention is to functionally interconnect the various components used in the manufacture of metal castings.

Still another object of the present invention is to contain waste gasses generated in the manufacture of metal castings.

Still another object of the present invention is to provide a method and system for putting waste gasses generated in the manufacture of metal castings to use.

Still another object of the present invention is to lower the height of a multipurpose furnace.

Still another object of the present invention is to provide a low-profile hopper for use, in combination with a plurality of fluidizers, within a furnace.

Other objects, features and advantages of the present invention will become apparent upon reading and understanding this specification, taken in conjunction with the accompanying drawings.

DETAILED DESCRIPTION OF THE PREFERRED EMBODIMENTS

Figure 1:
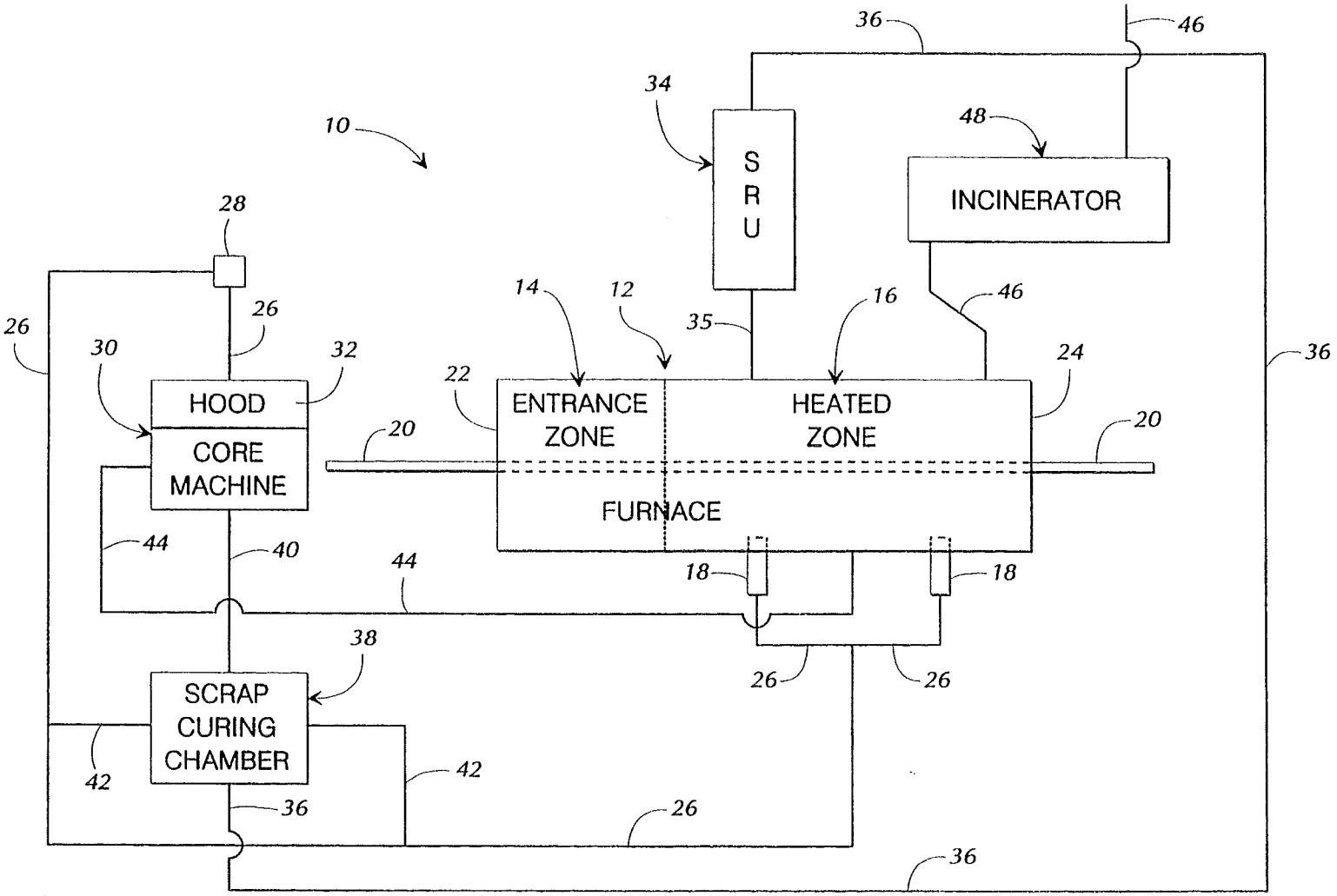
FIG. 1 is a schematic representation of a casting manufacturing system, in accordance with a first preferred embodiment of the present invention.

Referring now in greater detail to the drawings, in which like numerals represent like components throughout the several views, FIG. 1 is a schematic representation of a casting manufacturing system 10, in accordance with a first preferred embodiment of the present invention. Central to the system 10 is a furnace 12 that is integrally connected to and inventively cooperates with other components of the system 10. In accordance with the first preferred embodiment of the present invention, the furnace 12 includes an entrance zone 14 and a heated zone 16. The entrance zone 14 is a contiguous extension of the heated zone 16. The patents incorporated by reference fully disclose a multifunctional furnace with fluidizers, and in accordance with the preferred embodiment of the present invention, the heated zone 16 of the furnace 12 is, with the exception of having an entrance zone 14 contigous thereto, such a multifunctional furnace with fluidizers. In accordance with the first preferred embodiment of the present invention, one or a plurality of fluidizers 18 penetrate the heated zone 16 of the furnace 12, and a conveyerized hearth 20 extends through the furnace 12, through an inlet 22 of the furnace 12, through the entrance zone 14 and heated zone 16, and then through an outlet 24 of the furnace 12.

In accordance with the first preferred embodiment of the present invention, the fluidizers 18 (which are fully disclosed in U.S. Pat. No. 5,354,038 which was previously incorporated by reference) include a fluidizer outlet end that is disposed within the furnace 12 and a fluidizer inlet end that is connected to a gas conduit 26. The gas conduit 26 extends from the fluidizers 18 to a core making machine 30. Furthermore, the gas conduit 26, in accordance with the preferred embodiment, interacts with a gas pump 28. The core making machine 30 preferably includes a ventilating hood 32 to which the gas conduit 26 attaches, whereby the core making machine 30 is in fluid communication with the fluidizers 18 through the gas conduit 26.

In accordance with the first preferred embodiment of the present invention, the heated zone 16 of the furnace 12 is further connected to a sand refinement unit 34 (which is fully disclosed in U.S. Pat. No. 5,354,038 which has been previously incorporated herein by reference, where it is referred to as a supplemental sand reclamation unit). A discharge tube 35 extends from the sand refinement unit 34 into the heated zone 16 of the furnace 12. A cured scrap transport path 36 extends between the sand refinement unit 34 and a scrap curing chamber 38. An uncured scrap transport path 40 extends between the scrap curing chamber 38 and the core machine 30. As discussed in greater detail below, the scrap curing chamber is in selective communication with the gas conduit 26 by way of an alternate gas conduit 42.

In accordance with the first preferred embodiment of the present invention, a reclaimed sand transport path 44 extends between the heated zone 16 of the furnace 12 and the core making machine 30. Although not shown, in accordance with the first preferred embodiment, the reclaimed sand transport path 44 would interact with or include a cooler-classifier and silos. Additionally, in accordance with the first preferred embodiment, the heated zone 16 of the furnace 12 controllably vents to the atmosphere through an exhaust conduit 46 that communicates with an incinerator 48.

In accordance with the first preferred embodiment of the present invention, operation of the casting manufacturing system 10 begins at the core machine 30, where sand, a combustible binder, and an inducing gas are combined in a conventional manner, as would be understood by those reasonably skilled in the art, to form cores and molds. In alternate embodiments of the present invention, a reusable mold, such as, for example, a reusable cast iron mold, is employed such that molds are not produced in the core machine 30. When cores and molds are produced in accordance with the first preferred embodiment, the inducing gas is injected into the core machine 30 to cure the combustible binder. Preferably, an excess amount of inducing gas is injected into the core machine 30. In accordance with the first preferred embodiment of the present invention, the excess inducing gas is collected and employed, in an inventive manner, within the casting manufacturing system 10, as will be discussed in greater detail below.

Once cores and molds are prepared, cores are, in accordance with the first preferred embodiment of the present invention, placed within the molds for the pouring of castings, as would be understood by those reasonably skilled in the art. Each mold, preferably with a core or cores therein, is placed on the conveyerized hearth 20 that extends proximate to the core machine 30. The conveyerized hearth 20 conveys the molds thereon into the entrance zone 14 of the furnace 12, where molten casting material is poured into the molds to form castings within the molds. In accordance with the first preferred embodiment of the present invention, the entrance zone 14 of the furnace is maintained at a temperature that is less than the combustion temperature of the combustible binder of the cores and molds (referred to hereafter as cores), and the molten casting material solidifies in the entrance zone 14, whereby castings are formed. The fact that the molten casting material is poured within the furnace 12 is considered inventive. In accordance with the first preferred embodiment of the present invention, the environment within the heated zone 16 is maintained at a pressure slightly below the pressure of the environment within the entrance zone 14, whereby there is a general flow of gasses from the entrance zone 14 to the heated zone 16. Therefore, the heat given off by the molten casting material directly adds to the heating of the heated zone 16 of the furnace 12. Additionally, in accordance with the first preferred embodiment, the molten casting material, when initially poured within the entrance zone 14, is at a temperature above the combustion temperature of the combustible binder comprised by the cores, whereby the cores generate fumes (i.e., waste gas). Because the heated zone 16 of the furnace 12 is maintained at a pressure that is slightly less than the pressure maintained in the entrance zone 14 of the furnace 12, the fumes are drawn into the heated zone 16, whereby the fumes are inventively contained and controlled. In accordance with the first preferred embodiment of the present invention, the heated zone 16 of the furnace 12 is heated to approximately 1,000 degrees Fahrenheit, whereby the fumes drawn therein are thought to be at least partially combusted and incinerate, whereby they contribute to the heating of the heated zone 16. As a minimum, the fumes drawn into the heated zone 16 are preheated prior to their introduction into the incinerator 48, whereby operation of the incinerator 48 is enhanced.

In accordance with the first preferred embodiment of the present invention, the conveyerized hearth 20 conveys the castings formed in the entrance zone 14 into the heated zone 16. The cores are still attached to castings when the castings enter the heated zone 16. In accordance with the preferred embodiment of the present invention, the heated zone 16 is heated to a temperature that is greater than the combustion temperature of the combustible binder of the cores, and the castings within the heated zone 16 are subjected to great air speeds and differential pressure, as described in the patents previously incorporated herein by reference, whereby combustible binder of the cores combusts and the cores fall in pieces from the castings. In accordance with the first preferred embodiment, the larger pieces of core that fall are transformed into smaller pieces, and the smaller pieces fall into and are collected by hoppers located below the conveyerized hearth 20. As discussed in greater detail below, sand is reclaimed from the pieces of core that fall into the hoppers. Not only are the cores removed from the castings within the heated zone 16 of the furnace 12, the castings are additionally heat treated. After core removal and heat treatment, the castings are conveyed, by the conveyerized hearth 20, out of the outlet 24 of the furnace 12. In accordance with the first preferred embodiment of the present invention, the castings emerge from the furnace 12 in a clean state and are ready for, for example, air or water quenching, sawing, shot peening, machining, or shipment.

As mentioned above, sand is reclaimed within the furnace 12 from the pieces of core that fall into hoppers disposed below the conveyerized hearth 20 in the heated zone 16 of the furnace 12. The reclaimed sand is ejected from the heated zone 16 of the furnace 12, for example, by screw augers or dump valves. In accordance with the first preferred embodiment of the present invention, the ejected sand is transported along the reclaimed sand transport path 44 which eventually leads back to the core machine 30 where the reclaimed sand is reused in the formation of new cores. As discussed previously, in accordance with the first preferred embodiment, sand coolers, classifiers, and silos are located along and are operatively part of the reclaimed sand transport path 44. Additionally, in accordance with the first preferred embodiment of the present invention, the reclaimed sand transport path 44 comprises an assembly for transporting the reclaimed sand such as, for example, a vibratory conveyer.

In accordance with the first preferred embodiment of the present invention, the reclaiming of sand is carded out, at least in part, by the fluidizing action of the fluidizers 18. The detailed manner in which fluidizers 18 reclaim sand is fully disclosed in U.S. Pat. No. 5,354,038, which has been previously incorporated herein by reference. In brief, a pressurized gas is supplied under pressure to the inlets of the fluidizers 18 and the pressurized gas is expelled from the outlets of the fluidizers 18 such that the pieces of core within the hoppers are fluidized and sand is reclaimed therefrom. In accordance with the first preferred embodiment of the present invention, pressurized gas which is drawn into the hood 32 of the core machine 30 is supplied to the inlet of the fluidizers 18 through the gas conduit 26, and this is considered to be an inventive aspect of the present invention. In accordance with the first preferred embodiment, a large amount of oxygenated air is drawn into the hood 32 with the inducing gas due to operation of the gas pump 28. The gas pump 28 preferably supplies sufficient head to the inducing gas and air in the gas conduit 26 to force the inducing gas and air through the fluidizers 18 and thereby fluidize and reclaim sand from the pieces of core. In accordance with alternate embodiments of the present invention, multiple gas pumps 28 are employed to achieve proper fluidization. Not only is it believed that the collecting and injecting of inducing gas through the fluidizers 18 for fluidizing purposes is inventive, the injection of the inducing gas into the heated zone 16 of the furnace 12 is further believed to be inventive due to the fact that it is believed that the inducing gas is at least partially incinerated within the heated zone 16 due to the elevated temperature therein. As a minimum, the inducing gas is preheated within the heated zone 16 prior to being introduced into the incinerator 48, whereby operation of the incinerator 48 is enhanced.

As discussed previously, during the formation of cores, it is common for portions of combustible binder to remain uncured, thus, uncured scrap is generated that must be contended with. While uncured scrap is particularly messy to transport and deal with, cured scrap is much easier to transport and deal with; therefore, in accordance with the first preferred embodiment of the present invention, uncured scrap is converted into cured scrap, and this conversion is carried out in an inventive manner. In accordance with the first preferred embodiment of the present invention, uncured scrap is transported along the uncured scrap transport path 40 to the scrap curing chamber 38, where the uncured scrap is collected. In accordance with the first preferred embodiment of the present invention, the uncured scrap transport path 40 comprises an assembly for transporting the uncured scrap such as, for example, a vibratory conveyer. In accordance with the first preferred embodiment of the present invention, the uncured scrap collected in the scrap curing chamber 38 is exposed to inducing gas flowing through the gas conduit 26, whereby the uncured scrap is transformed into cured scrap. FIG. 1 depicts an acceptable example of a manner in which the scrap curing chamber 38 is capable of being exposed to inducing gas. As depicted in FIG. 1, a pair of control valves (not shown) are capable of being positioned in the alternate gas conduit 42 on opposite sides of the scrap curing chamber 38. An additional control valve (not shown) is capable of being placed in the gas conduit 26 between the connections of the alternate gas conduit 42 to the gas conduit 26. The control valves are selectively operated to selectively direct inducing gas through the scrap curing chamber 38.

In accordance with the first preferred embodiment of the present invention, cured scrap is ejected from the scrap curing chamber 38 and is transported along the cured scrap transport path 36 to the sand refinement unit 34. In accordance with the first preferred embodiment of the present invention, the cured scrap transport path 36 comprises an assembly for transporting the cured scrap such as, for example, a vibratory conveyer. The cured scrap is deposited from the cured scrap transport path 36 into the sand refinement unit 34. In accordance with the first preferred embodiment of the present invention, the sand refinement unit 34 is disposed above the furnace 12. The cured scrap deposited into the sand refinement unit 34 is partially reclaimed therein and is discharged therefrom through the discharge tube 35. The discharge tube 35 extends into the furnace 12 and deposits the partially reclaimed cured scrap into the hoppers within the heated zone 16 of the furnace 12 where the sand of the partially reclaimed cured scrap is fully reclaimed in the manner described above.

Additionally, in accordance with the first preferred embodiment of the present invention, the gasses within the furnace 12 are exhausted by way of the exhaust conduit 46 through the incinerator 48. The incinerator 48 operates in a conventional manner, as should be understood by those reasonably skilled in the art, to incinerate gasses not already incinerated within the furnace 12. In accordance with the first preferred embodiment of the present invention, the thermal input to the incinerator 48 is minimized due to the incineration and preheating carried out within the heated zone 16 of the furnace 12. Additionally, in accordance with the first preferred embodiment of the present invention, only the single incinerator 48 is employed to handle, in addition to the waste gas generated in the heated zone 16 of the furnace 12, the waste gas generated during the pouring of molten casting material and the excess inducing gas.

In accordance with the first preferred embodiment of the present invention, the combustible binder is an organic binder and the inducing gas is amine gas. Furthermore, inspection ports are preferably provided in the conduits 26,42 to facilitate inspection of the internal surfaces thereof. Such internal inspection, and possibly internal cleaning, might be necessary because it is believed that the amine gas will deposit along the internal surfaces of the conduits 26,42.

In accordance with an alternate embodiment of the present invention, the molten casting material is not poured into molds while the molds are within the furnace 12. Rather, the molten casting material is poured into molds at a location that is remote from the furnace 12. In accordance with this alternate embodiment, the waste gas generated when the molten casting material is poured into the molds is collected and forced through the fluidizers 18 and into the furnace 12 in much the same manner that inducing gas is collected from the core machine 30 and injected through the fluidizers 18 in the first preferred embodiment.

Figure 2:
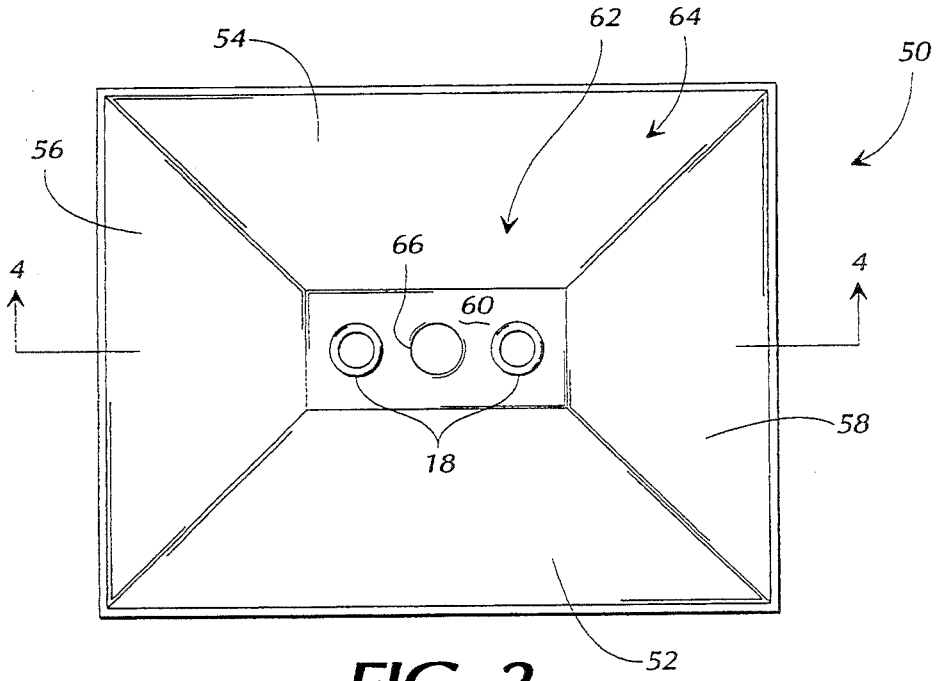
FIG. 2 is an isolated, top plan view of a hopper for use with a furnace, in accordance with a second preferred embodiment of the present invention.
Figure 3:
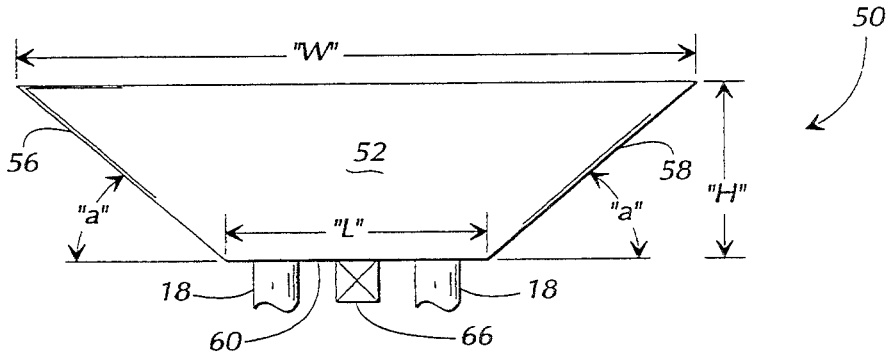
FIG. 3 is an isolated, front elevational view of the hopper of FIG. 2, with certain components partially cut-away.
Figure 4:
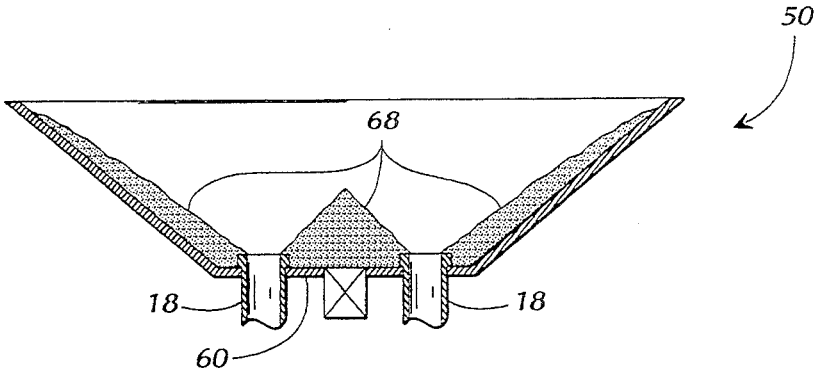
FIG. 4 is a cross-sectional view of the hopper of FIG. 2, with certain components partially cut-away, taken along line 4—4 of FIG. 2.

In accordance with a second preferred embodiment of the present invention, provisions are made to minimize the overall height of the furnace 12 (FIG. 1). Referring to FIGS. 2–4, these provisions include inventively shaping the hoppers 50 within the furnace 12, and inventively orienting fluidizers 18 within the hoppers 50. In accordance with the second preferred embodiment of the present invention, the height of the hoppers 50, and thereby the height of the furnace 12, is inventively decreased while optimal overall operation of the furnace 12 and fluidizers 18 is inventively maintained. In accordance with the second preferred embodiment of the present invention, hoppers 50 are disposed within the furnace 12 below the conveyerized hearth 20 (FIG. 1) and function to collect and contain pieces of core while sand is reclaimed therefrom. As mentioned previously, the patents previously incorporated herein by reference fully disclose hoppers and their arrangement within a furnace 12 for collection and reclaiming purposes.

FIG. 2 is an isolated, top plan view of a hopper 50, in accordance with the second preferred embodiment of the present invention. The hopper 50 includes a front wall 52, a rear wall 54, opposite side walls 56,58, and a base plate 60. The walls 52—58 define a chamber 62 therebetween and an inlet 64 through which pieces of core fall into the chamber 62. Fluidizers 18, which are partially cut-away in FIGS. 3 and 4, penetrate the base plate 60 so as to extend into the chamber 62. Additionally, a discharge device 66, shown schematically in FIGS. 2–4, penetrates the base plate 60 and provides for the discharge of reclaimed sand from the hopper 50. Acceptable discharge devices 66 include, for example, augers and dump valves. In accordance with the second preferred embodiment of the present invention, a plurality of hoppers 50 are disposed within the heated zone 16 (FIG. 1) of the furnace 12 (FIG. 1) in a series type arrangement, stretching along underneath the conveyerized hearth 20 (FIG. 1). For example, in accordance with the second preferred embodiment of the present invention, the top of the rear wall 54 of a first hopper 50 abuts the top of the front wall 52 of a second hopper 50, and so on.

FIG. 3 is an isolated, front elevational view of the hopper 50, with the fluidizers 18 partially cut-away, in accordance with the second preferred embodiment of the present invention. The hopper 50 defines a height "H" and a width "W" . Additionally, each of the walls 52–58 define an angle "a" with respect to the horizontal. For example, the angles "a" defined by the side walls 56,58 are shown in FIG. 3. In accordance with the second preferred embodiment of the present invention, the magnitude of angle "a" is defined as the "angle of slide" which is the minimum angle at which pieces of core and reclaimed sand disposed upon the walls 52–58 will slide toward the base plate 60. In accordance with the second preferred embodiment of the present invention, it is important that the angles "a" are the "angle of slide" so that the pieces of core and reclaimed sand within the hopper 50 flow toward and accumulate at the base plate 60. This provides, for example, for optimum fluidization and keeps pieces of core from piling up to and extending out of the hopper 50 where the pieces of core would interfere with operations within the furnace 12. In accordance with the second preferred embodiment of the present invention, the angles "a" are approximately thirty five degrees. In accordance with the second preferred embodiment, the height "H" of the hopper 50 has been decreased while maintaining the width "W" of the hopper 50 at a preselected value and the angles "a", defined by the walls 52–58, equal to the "angle of slide". In accordance with the second preferred embodiment of the present invention, this configuration has been facilitated by inventively increasing the length "L" of the base plate 60. In accordance with the second preferred embodiment, when "L" is increased, multiple fluidizers 18 are employed within the hopper 50. Referring additionally to FIG. 4, which is an isolated, partially cut-away, cross-sectional view of the hopper 50 taken along line 4—4 of FIG. 2, the employment of multiple fluidizers 18 is inventive and maintains proper flow of pieces of core and reclaimed sand, identified and depicted collectively as bulk material 68, toward the base plate 60. The employment of multiple fluidizers 18 also maintains proper fluidization of the bulk material 68. In accordance with the second preferred embodiment of the present invention, proper fluidization is critical, whereby the configuration of the hopper 50 and the fluidizers 18 is critical.

Whereas this invention has been described in detail with particular reference to preferred and alternate embodiments, it should be understood that variations and modifications can be effected within the spirit and scope of the invention, as described herein before and as defined in the appended claims.

I claim:

1. A method of manufacturing castings of the type constructed from a core, wherein the core comprises sand and a combustible binder, the method comprising the steps of:

disposing a casting with a core therein into a furnace, wherein the core comprises sand and a combustible binder;

disposing waste gasses into the furnace, wherein the waste gasses are collected from at least one operation selected from operations of making the core and forming the casting; and heating the furnace, wherein said step of heating the furnace includes, at least, the steps of, incinerating, within the furnace, the waste gasses disposed in the furnace during said step of dispensing waste gasses, combusting, within the furnace, combustible binder of the core, whereby portions of the core fall from the casting, and heat treating the casting.

2. The method of claim 1, wherein, the method further comprises the step of making the core from the sand and the combustible binder, wherein said step of making the core includes, at least, the steps of, combining sand and combustible binder, and exposing an inducing gas to the sand and the combustible binder, wherein the inducing gas induces the curing of the combustible binder and thus the formation of the core, and said step of disposing waste gasses includes, at least, the steps of, collecting inducing gas subsequent to said step of exposing, and injecting inducing gas collected during said collecting step into the furnace.

3. The method of claim 2, wherein, said step of making the core further includes, at least, the step of providing a core making structure, wherein said step of exposing an inducing gas to the sand and combustible binder is carried out in the core making structure, and said step of collecting inducing gas includes, at least, collecting inducing gas from the core making structure.

4. The method of claim 3, wherein said step of collecting inducing gas from the core making structure includes, at least, providing a hood proximate to the core making structure, and pulling a vacuum on the hood.

5. The method of claim 3, wherein, the method further comprises the step of reclaiming sand within the furnace, wherein said step of reclaiming sand includes, at least, collecting, within the furnace, the portions of the core that fall from the casting during said step of combusting combustible binder, providing a fluidizer proximate to the collected portions of the core, and fluidizing, within the furnace, with the fluidizer, the collected portions of the core, and said step of disposing waste gasses into the furnace includes, at least, injecting inducing gas into the furnace through the fluidizer, whereby said step of fluidizing includes, at least, fluidizing with inducing gas.

6. The method of claim 5, wherein, said step of collecting includes, at least, the step of providing a hopper within the furnace, and said step of providing a fluidizer includes, at least, the steps of, providing a plurality of fluidizers, and disposing the plurality of fluidizers at least partially within the hopper.

7. The method of claim 5, wherein, the method further comprises the step of providing a conduit connected and providing fluid communication between the core making structure and the fluidizer, said step of collecting inducing gas includes, at least, the step of drawing inducing gas from the core making structure into the conduit, and said step of injecting inducing gas into the furnace through the fluidizer includes, at least, the step of forcing inducing gas from the conduit into the fluidizer.

8. The method of claim 7, wherein the inducing gas includes, at least, amine gas.

9. The method of claim 7, wherein the method further comprises the steps of, providing an incinerator, and drawing gas from the furnace through the incinerator, whereby gas from the furnace is incinerated.

10. The method of claim 7, wherein, said step of exposing an inducing gas to the sand and combustible binder includes, at least, the steps of, curing portions of the combustible binder to form the core, and failing to expose portions of the combustible binder to the inducing gas, whereby portions of combustible binder and sand remain uncured and are thus uncured scrap, the method further comprises the steps of, providing a chamber, collecting and depositing the uncured scrap into the chamber, exposing the collected portions of uncured scrap within the chamber to inducing gas collected during said step of collecting inducing gas, whereby said collected portions of uncured scrap are cured to form cured scraps, wherein said step of exposing the collected portions of uncured scrap occurs prior to said step of injecting inducing gas into the furnace, introducing the cured scraps into the furnace, and subjecting the cured scraps to said step of reclaiming within the furnace.

11. The method of claim 10, wherein said step of exposing the collected portions of uncured scrap includes, at least, the step of placing the chamber in fluid communication with the conduit connected and providing fluid communication between the core making structure and the fluidizer.

12. The method of claim 11, wherein said step of introducing the cured scraps into the furnace includes, at least the steps of, providing a sand refinement unit, disposing cured scraps in the sand refinement unit, combusting combustible binder of cured scraps within the sand refinement unit, and directing cured scraps from within the sand refinement unit into the furnace were they are subjected to said step of reclaiming.

13. The method of claim 1, wherein, the method further comprises the step of forming the casting, wherein said step of forming the casting includes, at least, the steps of, providing a mold, disposing the core within the mold, and pouring molten casting material into the mold, whereby the core smokes, and said step of disposing waste gasses includes, at least, the steps of, collecting smoke generated as a result of said step of pouring molten casting material, and injecting smoke collected during said collecting step into the furnace.

14. The method of claim 1, wherein, said step of disposing a casting with a core therein into a furnace, includes, at least, the steps providing a mold, disposing the core within the mold, disposing the mold, with the core therein, into the furnace, and pouring molten casting material into the mold while the mold is in the furnace, wherein the core is within the mold, whereby the core smokes, and said step of disposing waste gasses includes, at least, containing the smoke generated during said step of pouring molten casting material within the furnace.

15. The method of claim 14, wherein, the furnace includes, at least, an entrance zone, and a heated zone adjacent to and downstream from the entrance zone, said step of heating the furnace further includes the step of heating the heated zone of the furnace to a temperature greater than the combustion temperature of the combustible binder, the method further comprises the step of maintaining the entrance zone of the furnace at a temperature below the combustion temperature of the combustible binder, said step of pouring molten casting material is carried out in the entrance zone, and said steps of combusting combustible binder of the core and heat treating are carried out in the heated zone.

16. The method of claim 15, further comprising the steps of, maintaining the environment within the entrance zone at a first pressure, and maintaining the environment within the heated zone at a second pressure that is less that said first pressure, whereby the core smoke is drawn from the entrance zone into the heated zone.

17. The method of claim 15, wherein the entrance zone abuts the heated zone.

18. The method of claim 15, wherein the entrance zone and the heated zone are contiguous.

* * * * *